US007493254B2

(12) United States Patent
Jung et al.

(10) Patent No.: US 7,493,254 B2
(45) Date of Patent: Feb. 17, 2009

(54) PITCH DETERMINATION METHOD AND APPARATUS USING SPECTRAL ANALYSIS

(75) Inventors: Doill Jung, Seoul (KR); Hunseok Seo, Seoul (KR)

(73) Assignee: Amusetec Co., Ltd. (KR)

( * ) Notice: Subject to any disclaimer, the term of this patent is extended or adjusted under 35 U.S.C. 154(b) by 879 days.

(21) Appl. No.: 10/486,065

(22) PCT Filed: Aug. 8, 2002

(86) PCT No.: PCT/KR02/01498

§ 371 (c)(1),
(2), (4) Date: Feb. 5, 2004

(87) PCT Pub. No.: WO03/015077

PCT Pub. Date: Feb. 20, 2003

(65) Prior Publication Data

US 2004/0225493 A1 Nov. 11, 2004

(51) Int. Cl.
*G10L 11/04* (2006.01)
*G10G 7/02* (2006.01)

(52) U.S. Cl. ..... 704/207; 704/205; 704/206; 84/454; 84/616

(58) Field of Classification Search ..... 700/94; 84/454–460, 616; 704/205–207
See application file for complete search history.

(56) References Cited

U.S. PATENT DOCUMENTS 4,384,335 A * 5/1983 Duifhuis et al. ..... 704/207
4,791,671 A * 12/1988 Willems ..... 704/217
5,226,108 A * 7/1993 Hardwick et al. ..... 704/200
5,696,873 A * 12/1997 Bartkowiak ..... 704/216
5,774,836 A * 6/1998 Bartkowiak et al. ..... 704/207
5,890,108 A * 3/1999 Yeldener ..... 704/208
5,973,252 A * 10/1999 Hildebrand ..... 84/603
6,012,023 A 1/2000 Iijima et al. ..... 704/207
6,035,271 A * 3/2000 Chen ..... 704/207

(Continued)

FOREIGN PATENT DOCUMENTS

KR 1998-032825 7/1998

OTHER PUBLICATIONS

Schroeder, M. R. "Period Histogram and Product Spectrum: New Methods for Fundamental-Frequency Measurement." Journal of the Acoustical Society of America, vol. 43, issue 4, 1968. pp. 829-834.*

(Continued)

*Primary Examiner*—Patrick N Edouard
*Assistant Examiner*—Gina W Lee
(74) *Attorney, Agent, or Firm*—Cantor Colburn LLP

(57) ABSTRACT

A method and apparatus for detecting a pitch using frequency analysis are provided. An externally input digital signal is analyzed into frequency component values at predetermined time intervals, and positions of peaks of the digital signal are detected based on the frequency component values. It is determined whether a frequency at a maximum peak position among the peak positions is a pitch or a n-order harmonic frequency of the pitch to detect a pitch. Then, the range of the pitch is determined based on the range of a harmonic frequency of the detected pitch. Accordingly, an error range for the pitch detected using frequency analysis is minimized, thereby more exactly detecting a pitch when the pitch is detected using the frequency analysis.

14 Claims, 6 Drawing Sheets

U.S. PATENT DOCUMENTS

| | | | | |
|---|---|---|---|---|
| 6,124,544 | A | 9/2000 | Alexander et al. | 84/616 |
| 6,526,376 | B1 * | 2/2003 | Villette et al. | 704/207 |
| 6,587,816 | B1 * | 7/2003 | Chazan et al. | 704/207 |
| 6,627,806 | B1 * | 9/2003 | Carpenter | 84/454 |
| 6,912,496 | B1 * | 6/2005 | Bhattacharya et al. | 704/228 |
| 2004/0133424 | A1 * | 7/2004 | Ealey et al. | 704/233 |

OTHER PUBLICATIONS

Maher, Robert C. and Beauchamp, James W. "Fundamental frequency estimation of musical signals using a two-way mismatch procedure." Journal of the Acoustical Society of America, vol. 95, issue 4, 1994. pp. 2254-2263.*

M. Piszczalski and B. Galler, "Predicting musical pitch from component frequency ratios," Journal of the Acoustical Society of America, vol. 66, No. 3, 1979.*

Sun, Xuejing (2000): "A pitch determination algorithm based on subharmonic-to-harmonic ratio", In ICSLP-2000, vol. 4, 676-679.*

PCT International Search Report; International application No. PCT/KR02/01498; International filing date: Aug. 8, 2002; Date of Mailing: Oct. 21, 2002.

PCT International Preliminary Examination Report; International application No. PCT/KR02/01498; International filing date: Aug. 8, 2002; Date of completion: Oct. 29, 2003.

* cited by examiner

FIG.3

| HARMONIC FREQUENCY DETECTION COEFFICIENT h | PEAK FFT INDEX 31 | FREQUENCY RANGE 32 ACCORDING TO PEAK FFT INDEX | | FREQUENCY RANGE 33 CALCULATED BY (h-TH HARMONIC FREQUENCY RANGE/h) | | FINAL PITCH RANGE 34 | |
|---|---|---|---|---|---|---|---|
| 1 | 13 | 129.1992 | 139.9658 | 129.1992 | 139.9658 | 129.1992 | 139.9658 |
| 2 | 25 | 258.3984 | 269.1650 | 129.1992 | 134.5825 | 129.1992 | 134.5825 |
| 3 | 37 | 387.5977 | 398.3643 | 129.1992 | 132.7881 | 129.1992 | 132.7881 |
| 4 | 49 | 516.7969 | 527.5635 | 129.1992 | 131.8909 | 129.1992 | 131.8909 |
| 5 | 62 | 656.7627 | 667.5293 | 131.3525 | 133.5059 | 131.3525 | 131.8909 |
| 6 | 74 | 785.9619 | 796.7285 | 130.9937 | 132.7881 | 131.3525 | 131.8909 |
| 7 | 86 | 915.1611 | 925.9277 | 130.7373 | 132.2754 | 131.3525 | 131.8909 |
| 8 | 98 | 1044.3604 | 1055.1270 | 130.5450 | 131.8909 | 131.3525 | 131.8909 |
| 9 | 110 | 1173.5596 | 1184.3262 | 130.3955 | 131.5918 | 131.3525 | 131.5918 |
| 10 | 123 | 1313.5254 | 1324.2920 | 131.3525 | 132.4292 | 131.3525 | 131.5918 |
| 11 | 135 | 1442.7246 | 1453.4912 | 131.1568 | 132.1356 | 131.3525 | 131.5918 |
| 12 | 147 | 1571.9238 | 1582.6904 | 130.9937 | 131.8909 | 131.3525 | 131.5918 |
| 13 | 160 | 1711.8896 | 1722.6563 | 131.6838 | 132.5120 | NO CALCULATION WITH NO INTERSECTION | |
| 14 | 173 | 1851.8555 | 1862.6221 | 132.2754 | 133.0444 | | |

OUTPUT RESULT

PITCH DETERMINATION METHOD AND APPARATUS USING SPECTRAL ANALYSIS

TECHNICAL FIELD

The present invention relates to a pitch determination method and apparatus, and more particularly, to a pitch detection method and apparatus for detecting a pitch using a maximum peak frequency obtained using frequency analysis and determining the frequency range of the pitch based on the range of one of the harmonic frequencies of the pitch.

BACKGROUND ART

Technology of detecting the pitches (pitch frequencies) of the sound of a musical instrument played in real time or the pitches (pitch frequencies) of a person's voice has been developed and researched in order to extract performance information data on the performing sound of the musical instrument or the person's voice or to play real-time music in concert.

Methods usually used to detect pitches include a frequency analysis method of analyzing the frequency of a digital signal of performing sound or voice, a period calculation method of calculating a peak or zero-crossing period of a waveform in order to calculate the period of a wave and analyzing the result of calculation, and an autocorrelation method of analyzing the autocorrelation of a waveform.

Among these pitch detection methods, in the frequency analysis method, a digital signal is analyzed at predetermined time intervals. A pitch is determined with a predetermined error range depending on the predetermined time interval.

For example, in the case of FFT (Fast Fourier Transform) used for the frequency analysis method, a digital signal input during each predetermined time interval (hereinafter, referred to as an index) is converted into a frequency. When a sampling rate and an FFT window size are fixed, the error range for the frequency is determined by the range of the index. This operation will be described with reference to the following formulas.

When a sampling rate for FFT is 22,050 Hz and an FFT window size is 1024, a frequency detected through the FFT is expressed as Formula (1).

$$FFT(F) = \frac{\text{Sampling rate}}{FFT\text{ window size}} \times \frac{\text{Index} + (\text{Index} - 1)}{2} \tag{1}$$

Here, actual frequency range FR is determined according to Formula (2).

$$FR = \frac{\text{Sampling rate}}{FFT\text{ window size}} \times (\text{Index} - 1) \sim \frac{\text{Sampling rate}}{FFT\text{ window size}} \times (\text{Index}) \tag{2}$$

Accordingly, when the index of a peak with respect to a fundamental frequency is 7 as the result of performing FFT analysis on a note C3 tuned on a piano, if the index of 7 and the above-described conditions (sampling rate and FFT window size) are applied to Formulas (1) and (2), the frequency transformation result and actual frequency range with respect to the index of 7, i.e., a seventh frequency, are calculated by Formula (3) and Formula (4), respectively.

Formula (3) directs to the calculation of the frequency transformation result, and Formula (4) directs to the calculation of an error range for the frequency transformation result.

$$\begin{aligned} FFT(F) &= \frac{22050}{1024} \times \frac{7 + (7 - 1)}{2} \\ &= \frac{22050}{1024} \times 6.5 \\ &= 139.96\ (\text{Hz}) \end{aligned} \tag{3}$$

$$\begin{aligned} FR_{FFT} &= \frac{22050}{1024} \times (7 - 1) \sim \frac{22050}{1024} \times 7 \\ &= 129.19 \sim 150.73 \end{aligned} \tag{4}$$

That is, a frequency, which is detected by performing the FFT on the note C3 of the piano under the above conditions, is 139.96 Hz, and the actual frequency range of the frequency is (129.19~150.73) Hz. Accordingly, the detected frequency has an error range of about 21.53 Hz (150.73-129.192=21.53).

Consequently, when using the FFT in order to detect the pitches of the sound of a musical instrument, a pitch detection error is small in a high-frequency band, in which a frequency interval between notes is equal to or greater than 21.53 Hz, but is large in a low-frequency band, in which a frequency interval between notes is less than 21.53 Hz.

DISCLOSURE OF THE INVENTION

To solve the above-described problems, it is a first object of the present invention to provide a pitch detection method and apparatus for determining whether the frequency of a maximum peak obtained using frequency analysis is a pitch or the n-order harmonic frequency of the pitch and detecting a pitch based on the result of determination, thereby minimizing a pitch detection error.

It is a second object of the present invention to provide a pitch detection method and apparatus for determining a frequency range for a pitch based on the range of a harmonic frequency having a predetermined interval maintained with respect to a pitch among the harmonic frequencies of the pitch, thereby reducing an error range for the pitch.

To achieve the first object of the present invention, there is provided a method of detecting a pitch using frequency analysis. The method includes a first step of analyzing an externally input digital signal into frequency component values at predetermined time intervals and detecting positions of peaks of the digital signal based on the frequency component values; and a second step of selecting a maximum peak position from the detected peak positions, determining whether a frequency at the maximum peak position is a pitch or an n-order harmonic frequency of the pitch, and detecting the pitch based on the result of the determination. Preferably, the second step includes (2-1) determining the frequency at the maximum peak position among the detected peak positions as a pitch candidate; (2-2) dividing a pitch candidate distance "d" between a frequency analysis start point and the position of the pitch candidate by "n" so as to calculate a peak detection interval d/n and determining whether peaks exist in the frequency spectrum between the frequency analysis start point and the pitch candidate position at peak detection intervals d/n; (2-3) if it is determined that peaks exist at peak detection intervals d/n, determining the pitch candidate as an n-order harmonic frequency of a peak P_Peak at a position P obtained by dividing the pitch candidate distance "d" by "n"; (2-4) setting the peak P_Peak at the position P as a new pitch candidate and repeating steps (2-2) and (2-3); and (2-5) if it is determined that peaks do not exist at peak detection intervals d/n, determining the pitch candidate as a pitch.

There is also provided an apparatus for detecting a pitch using frequency analysis. The apparatus includes a frequency analyzer, which analyzes an externally input digital signal into frequency component values at predetermined time intervals and detects positions of peaks of the digital signal based on the frequency component values; a pitch determiner, which selects a maximum peak position from the peak positions detected by the frequency analyzer as a pitch candidate, determines whether the pitch candidate is a pitch or an n-order harmonic frequency of the pitch, and when the frequency of the maximum peak position is determined as the n-order harmonic frequency, determines a frequency at a position, which is obtained by dividing a distance between a frequency analysis start point and the maximum peak position by "n", as a pitch; and a result output unit, which outputs the pitch determined by the pitch determiner.

To achieve the second object of the present invention, there is provided a method of detecting a pitch using frequency analysis. The method includes a first step of analyzing an externally input digital signal into frequency component values at predetermined time intervals and determining a pitch based on the frequency component values, and a second step of detecting a position of a harmonic frequency of the determined pitch and determining a range of the pitch based on the range of the harmonic frequency. Preferably, the second step includes calculating a frequency range $F_1$ of the pitch determined in the first step; calculating a frequency range $F_2$ by dividing the range of a harmonic frequency positioned at an h-th place from the pitch among harmonic frequencies, which can be detected with respect to the pitch, by "h"; and determining an intersection between the frequency range $F_1$ and the frequency range $F_2$ as the range of the pitch.

There is also provided an apparatus for detecting a pitch using frequency analysis. The apparatus includes a frequency analyzer, which analyzes an externally input digital signal into frequency component values at predetermined time intervals and detects positions of peaks of the digital signal based on the frequency component values; a pitch determiner, which selects a maximum peak position from the peak positions detected by the frequency analyzer, determines whether a frequency at the maximum peak position is a pitch or an n-order harmonic frequency of the pitch, and detects the pitch based on the result of the determination; a pitch range determiner, which detects a position of a harmonic frequency of the pitch determined by the pitch determiner and determines the range of the pitch based on the range of the harmonic frequency; and a result output unit, which outputs a pitch determined by the pitch determiner.

BRIEF DESCRIPTION OF THE DRAWINGS

FIG. 3 is a diagram showing the results of calculating pitch ranges in order to explain a procedure for determining a pitch range according to the present invention.

BEST MODE FOR CARRYING OUT THE INVENTION

Hereinafter, embodiments of a pitch detection method and apparatus according to the present invention will be described in detail with reference to the attached drawings.

Figure 1:
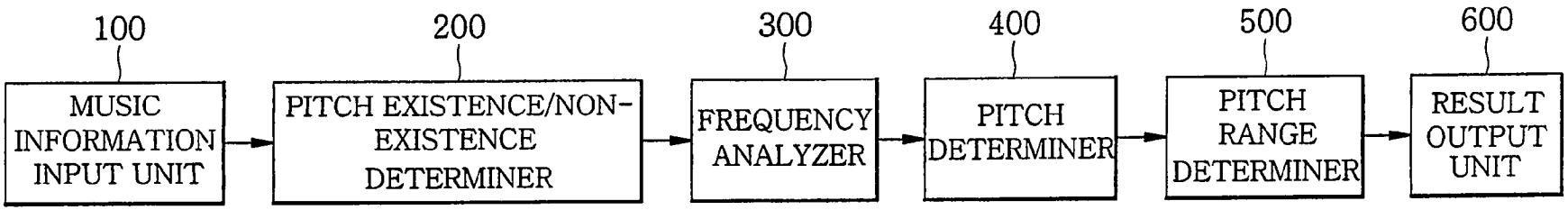
FIG. 1 is a schematic block diagram of a pitch detection apparatus according to an embodiment of the present invention.

FIG. 1 is a schematic block diagram of a pitch detection apparatus according to an embodiment of the present invention. Referring to FIG. 1, the pitch detection apparatus according to the embodiment of the present invention includes a music information input unit 100, a pitch existence/non-existence determiner 200, a frequency analyzer 300, a pitch determiner 400, a pitch range determiner 500, and a result output unit 600.

The music information input unit 100 converts an analog signal input through a microphone into a digital signal or receives a digital signal generated through conversion.

The pitch existence/non-existence determiner 200 senses the sound pressure level of a signal received through the music information input unit 100 to determine whether a pitch exists. In other words, when the sound pressure level of the signal received through the music information input unit 100 is higher than the sound pressure level of noise, which is predetermined taking into account a peripheral environment, it is considered that a signal of music sound is input.

The frequency analyzer 300 analyzes a digital signal of sound input through the pitch existence/non-existence determiner 200 into frequency component values at predetermined time intervals and detects the peak positions of the frequency spectrum using the frequency component values. A peak position denotes the position of a peak frequency. In the meantime, to analyze digital signal of sound n to frequency components, Fast Fourier Transform (FFT) is usually used, but another method such as wavelet transform can be used.

The pitch determiner 400 selects a maximum peak position from the peak positions detected by the frequency analyzer 300 as a pitch candidate. The maximum peak position denotes the position of a maximum peak frequency. In addition, the pitch determiner 400 determines whether the frequency of the pitch candidate is a pitch or the n-order harmonic frequency of a pitch. When the frequency of the maximum peak position is determined as an n-order harmonic frequency, the pitch determiner 400 determines a frequency at a position, which is obtained by dividing a distance between a frequency analysis start point and the maximum peak position by "n", as a pitch.

To determine whether a pitch candidate is an n-order harmonic frequency, the pitch determiner 400 divides a distance "d" between a frequency analysis start point and the position of the pitch candidate by "n" to calculate a peak detection interval d/n. Thereafter, the pitch determiner 400 checks the frequency spectrum to find out whether peaks exist in the frequency spectrum between the frequency analysis start point and the pitch candidate position at peak detection intervals d/n. If peaks exist at peak detection intervals d/n, the pitch determiner 400 performs step 1 of setting a peak P_Peak at a position P, which is obtained by dividing the distance "d" by "n", as a new pitch candidate.

The pitch determiner 400 repeats the step 1 until no peaks exist in the frequency spectrum between the frequency analysis start point and the pitch candidate position at peak detection intervals d/n. When no peaks exist in the frequency spectrum between the frequency analysis start point and the pitch candidate position at peak detection intervals d/n, a current pitch candidate is determined as a pitch. Here, "n" is a "pitch candidate property determination coefficient" for determining whether the pitch candidate is an n-order harmonic frequency. Preferably, prime numbers (2, 3, 5, 7, 11, 13, . . . ) within a predetermined range are sequentially applied to "n". It is apparent that "n" is not restricted to prime number within a predetermined range, but a natural number equal to or greater than 2 may be applied to "n".

The pitch range determiner 500 detects the position of a harmonic frequency of the pitch determined by the pitch determiner 400 and determines the range of the pitch based on the range of the harmonic frequency. In other words, the pitch range determiner 500 calculates a frequency range $F_1$ of the pitch determined by the pitch determiner 400; calculates a frequency range $F_2$ by dividing the range of a harmonic frequency positioned at an h-th place from the pitch among harmonic frequencies, which can be detected with respect to the pitch, by "h"; and determines an intersection between the frequency range $F_1$ and the frequency range $F_2$ as the range of the pitch. Here, "h" is a "harmonic frequency detection coefficient" for selecting a harmonic frequency for determining a pitch range. A natural number equal to or greater than 2 is used as "h".

The result output unit 600 outputs a finally determined pitch.

Figure 2:
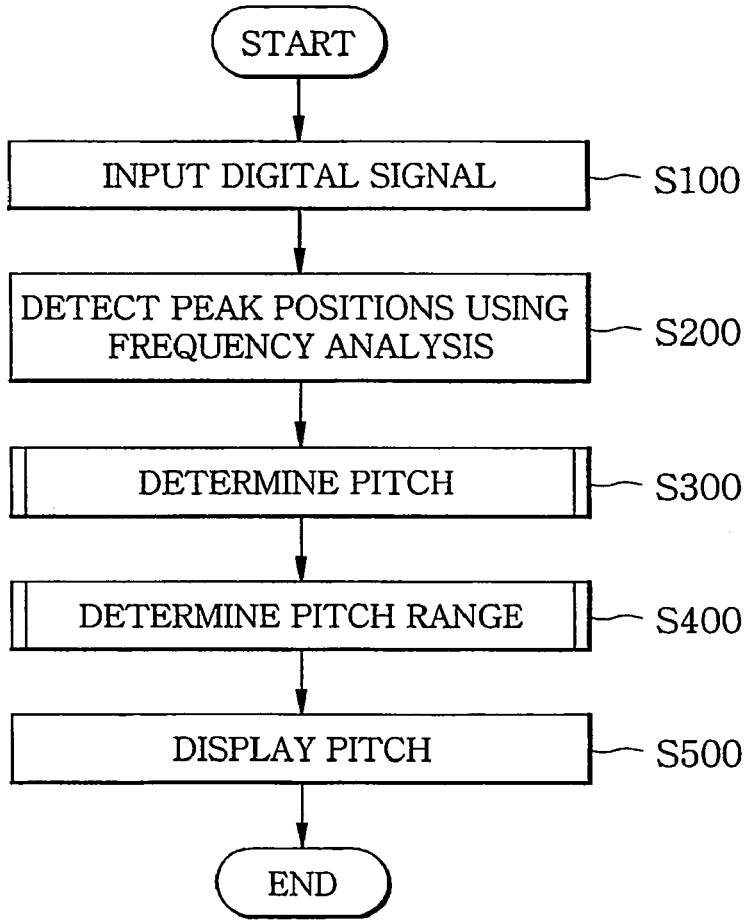
FIG. 2 is a flowchart of a pitch detection method according to an embodiment of the present invention.

FIG. 2 is a flowchart of a pitch detection method according to an embodiment of the present invention.

Figure 4A:
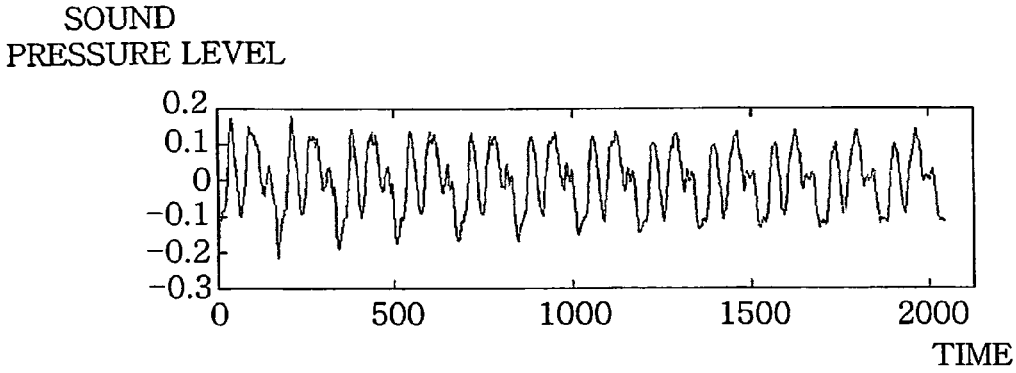
FIGS. 4A through 4C are exemplary waveform and frequency spectrum diagrams for explaining a procedure for detecting a pitch according to an embodiment of the present invention.
Figure 4B:
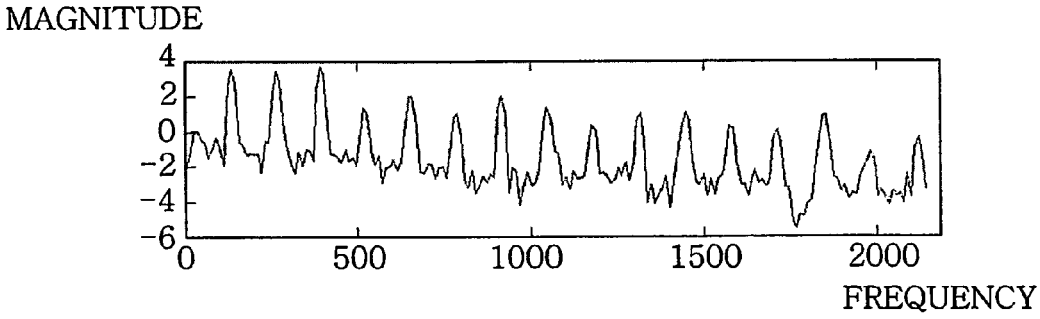
Figure 4C:
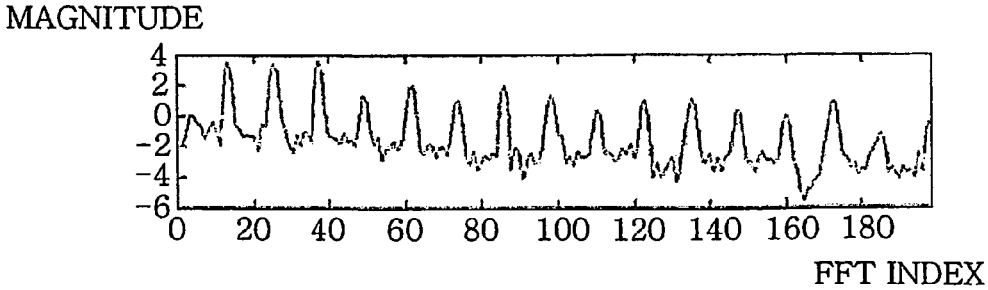

Referring to FIG. 2, when a digital signal is input from the outside in step S100, frequency analysis is performed to detect peak positions of the digital signal in step S200. FIG. 4A shows a waveform of a digital signal input from the outside, and FIGS. 4B and 4C show the results of performing frequency analysis on the digital signal. FIG. 4B shows peaks and their frequency positions, and FIG. 4C shows peaks and their FFT index positions. Accordingly, the positions of peaks can be detected using such waveform diagrams.

A pitch is determined with reference to a frequency spectrum showing the peaks in step S300. In other words, a maximum peak position is detected, and then a pitch is determined based on the result of determining whether the frequency of the maximum peak is a pitch or an n-order harmonic frequency of a pitch.

If a pitch is determined, the frequency range of the pitch is determined in step S400. The frequency range of the pitch is determined by reducing the frequency range of the pitch using harmonic frequencies of the pitch. A finally determined pitch is displayed in step S500.

Figure 2A:
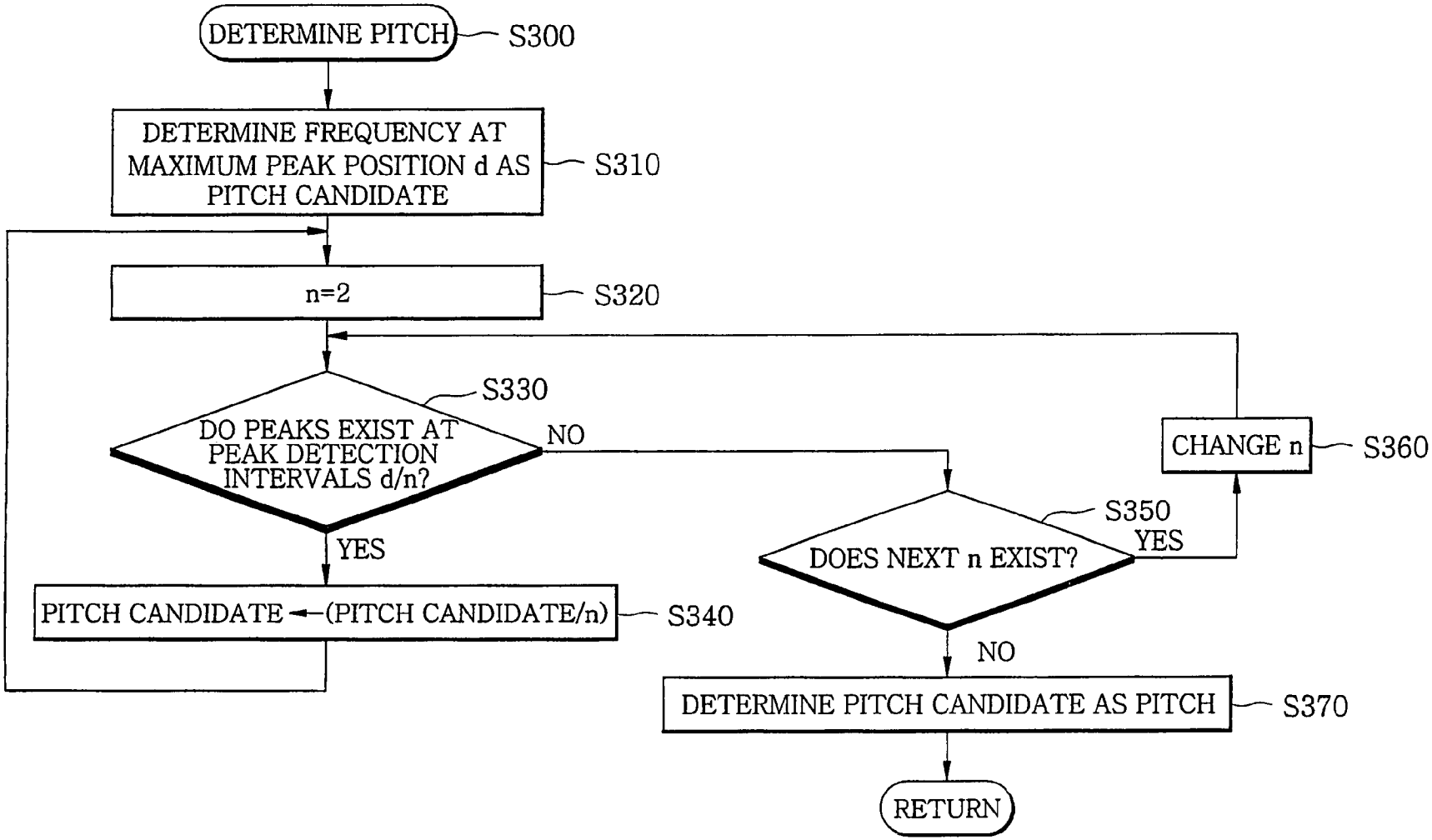
FIG. 2A is a flowchart of a method of determining a pitch according to an embodiment of the invention.

FIG. 2A is a flowchart of step S300 of determining a pitch. Referring to FIG. 2A, a frequency at the maximum peak position among the peak positions detected in step S100 is determined as a pitch candidate in step S310.

Next, a distance "d" between a frequency analysis start point and the position of the pitch candidate (hereinafter, the distance "d" is referred to as a "pitch candidate distance") is divided by "n" so as to calculate a peak detection interval d/n. Thereafter, the frequency spectrum is checked to find out whether peaks exist in the frequency spectrum between the frequency analysis start point and the pitch candidate position at peak detection intervals d/n. If peaks exist at peak detection intervals d/n, that is, if a peak P_Peak exists at a position P obtained by dividing the pitch candidate distance "d" by "n", the current pitch candidate is determined as the n-order harmonic frequency of the peak P_Peak. Here, "n" is a "pitch candidate property determination coefficient" for determining whether the pitch candidate is an n-order harmonic frequency. Preferably, prime numbers or natural numbers within a predetermined range are sequentially applied to "n".

Hereinafter, it is assumed that prime numbers within a predetermined range are applied to "n". To determine whether the pitch candidate is an n-order harmonic frequency, first, the pitch candidate property determination coefficient (hereinafter, referred to as "n") is set to 2 in step S320. The pitch candidate distance "d" between the frequency analysis start point and the pitch candidate position is divided by 2 so as to calculate a peak detection interval d/2. Then, it is checked whether peaks exist in the frequency spectrum between the frequency analysis start point and the pitch candidate position at peak detection intervals d/2 in step S330. In other words, it is checked whether a peak exists at a position P, which is a ½ of the pitch candidate distance "d".

If a peak exists at the position P, the pitch candidate is determined as the secondary harmonic frequency of the peak P_Peak at the position P, and the peak P_Peak at the position P is set as a new pitch candidate in step S340. Thereafter, steps S320 and S330 are repeated.

If a peak does not exist at the position P obtained by dividing the pitch candidate distance "d" by 2, "n" is changed from 2 into the next prime number 3 in step S360. Then, steps S330 and S340 are repeated. More specifically, the pitch candidate distance "d" between the frequency analysis start point and the pitch candidate position is divided by 3 so as to calculate a peak detection interval d/3, and then it is checked whether peaks exist in the frequency spectrum between the frequency analysis start point and the pitch candidate position at peak detection intervals d/3 in step S330. In other words, it is checked whether a peak exists at a position $P_1$, which is ⅓ of the pitch candidate distance "d", and whether a peak exists at a position $P_2$, which is ⅔ of the pitch candidate distance "d".

Steps S330 and S340 are repeated until all prime numbers within the predetermined range are applied to "n". For example, "n" is set in a range of {2, 3, 5}, steps S330 and S340 are repeated while changing "n" from 2 to 3 and to 5.

If it is determined that peaks do not exist in the frequency spectrum between the frequency analysis start point and the pitch candidate position at peak detection intervals d/n with respect to all prime numbers within the predetermined range in step S350, the pitch candidate is determined as a pitch in step S370.

Alternatively, natural numbers within a predetermined range can be applied to "n". For example, steps S330 and S340 may be repeated while changing "n" from 2 to 3, to 4, and to 5.

Figure 2B:
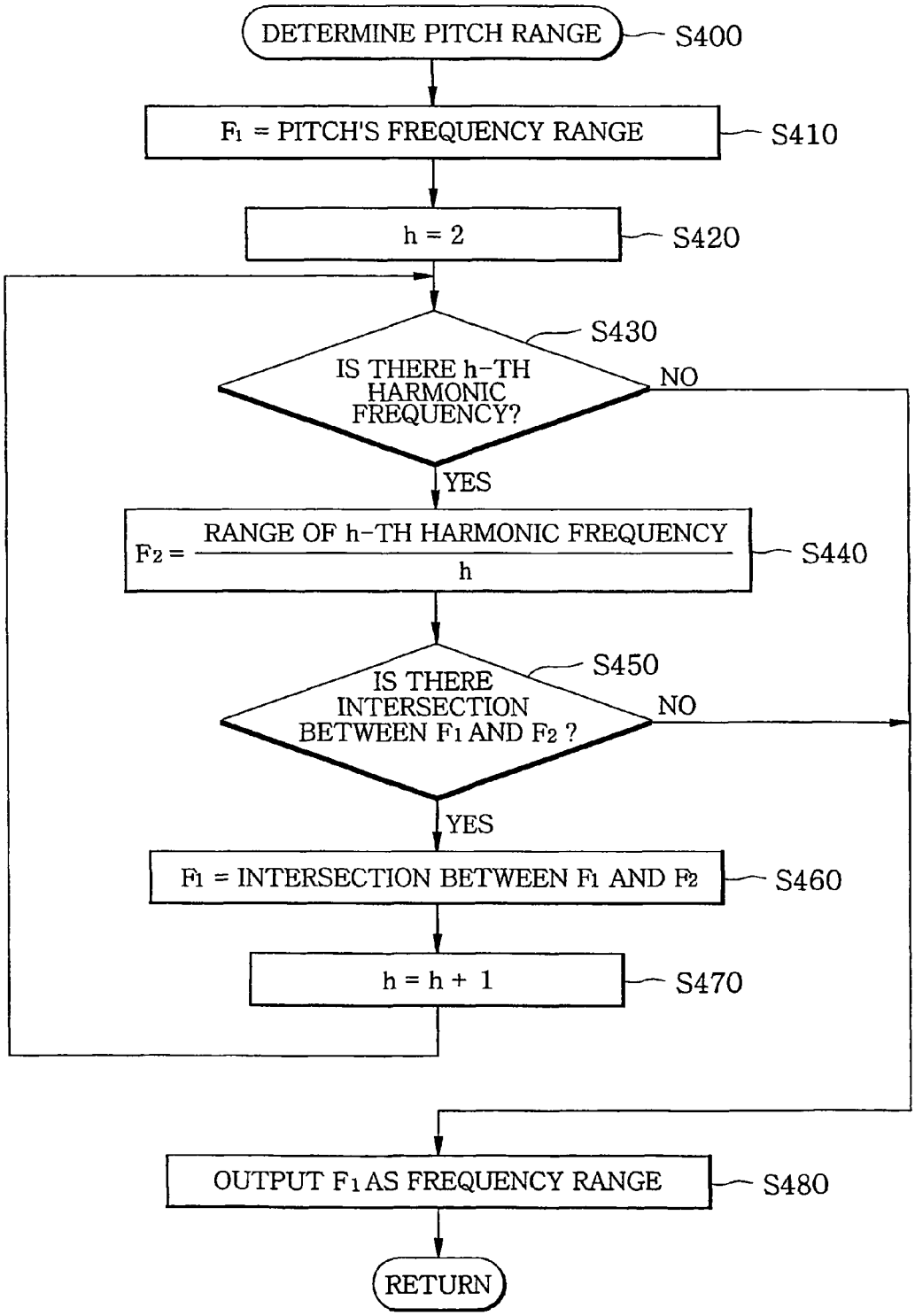
FIG. 2B is a flowchart of a method of determining a pitch range according to an embodiment of the invention.

FIG. 2B is a flowchart of step S400 of determining a pitch range. In order to determine a pitch range according to an embodiment of the present invention, the frequency range $F_1$ of the determined pitch is calculated, and then an intersection between the frequency range $F_1$ of the current pitch and the frequency range $F_2$ is determined as a pitch range. The frequency range $F_2$ is obtained by dividing the range of a harmonic frequency, which is positioned at an h-th place from the current pitch among the detectable harmonic frequencies of the current pitch, by "h".

Referring to FIG. 2B, the frequency range of the currently determined pitch is set as the pitch's frequency range $F_1$ in step S410. A harmonic frequency detection coefficient (hereinafter, referred to as "h") for selecting a harmonic frequency for determining the pitch range is set to 2 in step S420.

When it is determined that there is the second harmonic frequency of the current pitch in step S430, a frequency range obtained by dividing the range of the second harmonic frequency by 2 is determined as a pitch range candidate $F_2$ in step S440. Next, an intersection between the pitch range candidate $F_2$ and the previously determined pitch range $F_1$ is set a new pitch candidate $F_1$ in steps S450 and S460.

After increasing "h" by 1 in step S470, steps S430 through S460 are repeated.

More specifically, after setting "h" to 3 in step S470, if it is determined that there is the third harmonic frequency of the current pitch in step S430, a frequency range obtained by dividing the range of the third harmonic frequency by 3 is determined as a new pitch range candidate $F_2$ in step S440. Then, an intersection between the new pitch range candidate $F_2$ and the previously determined pitch range $F_1$ is set a new pitch candidate $F_1$ in steps S450 and S460.

Here, if there is no intersection between the pitch range candidate $F_2$ and the previously determined pitch range $F_1$, the previous determined pitch range $F_1$ is determined and output as the frequency range of a pitch in step S480.

In the meantime, if the h-th harmonic frequency of the current pitch is not detected or the magnitude of the h-th harmonic frequency is less than a predetermined value in step S430, the current pitch range $F_1$ is determined and output as the frequency range of a pitch in step S480.

In order to more specifically explain the above procedures, a pitch detection method will be described on the assumption that an FFT window size is 2048, a sampling rate is 22050 Hz, and the result of FFT is shown in FIG. 4C.

Referring to FIG. 4C, as the result of FFT, a plurality of peaks appeared, and the positions, i.e., FFT indexes of the peaks (hereinafter, referred to as peak FFT indexes) were 13, 25, 37, 49, 62, 74, 86, 98, 110, 123, 135, 147, 160, 173, . . . from the left of the graph.

The maximum peak having the maximum peak value is at the position of an FFT index of 37.

In the meantime, Formula (5) arithmetically shows a method of determining a frequency range using an FFT index. If an FFT index of 37 is applied to the Formula (5), a frequency range is calculated by Formula (6).

$$\text{Frequency range with respect to } FFT \text{ index} = \frac{\text{Sampling rate}}{\text{Window size}} \times (FFT \text{ index} - 1) \sim \frac{\text{Sampling rate}}{\text{Window size}} \times FFT \text{ index} \tag{5}$$

$$\text{Frequency range with respect to } FFT \text{ index} = \frac{22050}{2048} \times (37 - 1) \sim \frac{22050}{2048} \times 37 = 387.59 \sim 398.36 \tag{6}$$

That is, when the FFT index is 37, a frequency range is (387.59~398.36) Hz, which is a pitch candidate.

After determining the pitch candidate as described above, it is determined whether the pitch candidate is an n-order harmonic frequency by checking whether a peak exists at a position obtained by dividing the pitch candidate by "n". Here, it is preferable to sequentially apply 2, 3, 5, . . . to "n". In other words, it is preferable to sequentially apply prime numbers within a predetermined range to "n". However, "n" is not restricted to the prime numbers within a predetermined range. It is apparent that natural numbers within a predetermined range may be applied to "n".

The FFT index is calculated using "n" according to Formula (7). When "n" is 2, the FFT index is calculated according to Formula (8).

$$FFT \text{ index} = \frac{\text{Pitch candidate} \times \frac{n-m}{n} \times \text{Window size}}{\text{Sampling rate}}, \ (1 \le m \le n-1) \tag{7}$$

$$FFT \text{ index} = \frac{\frac{387.59}{2} \times 2048}{22050} \sim \frac{\frac{398.36}{2} \times 2048}{22050} = 18 \sim 18.5 \tag{8}$$

Referring to Formula (8), when "n" is 2, when the pitch candidate is divided by "n", the FFT index is 18~18.5. Referring to the peak FFT indexes 13, 25, 37, 49, 62, 74, 86, 98, 110, 123, 135, 147, 160, 173, . . . , it can be inferred that a peak does not exist at the position calculated according to Formula (8).

When "n" is 3, the FFT index is calculated according to Formula (9).

$$FFT \text{ index} = \frac{387.59 \times \frac{1}{3} \times 2048}{22050} \sim \frac{398.36 \times \frac{1}{3} \times 2048}{22050} = 12 \sim 12.33 \tag{9}$$

$$FFT \text{ index} = \frac{387.59 \times \frac{2}{3} \times 2048}{22050} \sim \frac{398.36 \times \frac{2}{3} \times 2048}{22050} = 24 \sim 24.66$$

Referring to Formula (9), when "n" is 3, two FFT indexes 12~12.33 and 24~24.66 are obtained. If 12.33 is rounded up to first decimal place, it becomes 13, and if 24.66 is rounded up to the first decimal place, it becomes 25. Accordingly, referring to the peak FFT indexes 13, 25, 37, 49, 62, 74, 86, 98, 110, 123, 135, 147, 160, 173, . . . , it can be inferred that when n=3, peaks exists at the position 13, i.e., ⅓ of the distance 37 between the frequency analysis start point to the pitch candidate, and the position 25, i.e., ⅔ of the distance 37 between the frequency analysis start point to the pitch candidate.

Therefore, it can be concluded that a frequency at the FFT index 37 is the tertiary harmonic frequency of a frequency at the FFT index 13. According to the present invention, in the result of FFT shown in FIG. 4C, a pitch is 129.19~132.78 Hz obtained by applying the FFT index 12~12.33 obtained using Formula (9) to Formula (5). The pitch is calculated by Formulas (10) and (11).

$$FFT \text{ index frequency range} = \frac{22050}{2048} \times 12 \sim \frac{22050}{2048} \times 12.33 = 129.19 \sim 132.78 \tag{10}$$

Here, the pitch has an error range of about 3.59 Hz.

A pitch range determining method of the present invention is used to reduce the error range. Harmonic frequency information which can be detected from the currently determined pitch (i.e., the frequency at the FFT index 13) can be obtained from the peak FFT indexes 13, 25, 37, 49, 62, 74, 86, 98, 110, 123, 135, 147, 160, 173, . . . When the harmonic frequency detection coefficient "h" is 12, a 12-th harmonic frequency is a frequency when the FFT index is 147.

Accordingly, the result of calculating the FFT index frequency range according to Formula (5) is expressed as Formula (11).

$$FFT \text{ index frequency range} = \frac{22050}{2048} \times (147-1) \sim \frac{22050}{2048} \times 147 = 1571.9238 \sim 1582.6904 \quad (11)$$

That is, the range of the 12-th harmonic frequency of the pitch is 1571.9238~1582.6904 Hz. Accordingly, the frequency range of a pitch is obtained by dividing the harmonic frequency range by 12, as shown in Formula (12).

$$\text{Fundamental frequency using harmonic frequency} = \frac{1571.9238}{12} \sim \frac{1582.6904}{12} = 130.9937 \sim 131.8909 \quad (12)$$

The frequency range obtained by Formula (12) is within the initial pitch range 129.18?132.78 obtained by Formula (10) and has an error range of 0.8972 Hz, which is remarkably smaller than the error range of about 3.5 Hz for the initial pitch range obtained by Formula (10). Accordingly, the frequency range can be more accurately detected when a pitch is detected according to the present invention.

If the frequency range obtained by Formula (12) is 130.9937~133.0 Hz, a final pitch range is 130.9937~132.78 Hz, i.e., an intersection between the frequency range 130.9937~133.0 Hz and the initial pitch range 129.19~132.78 Hz.

FIG. 3 is a diagram showing the results of calculating frequency ranges in order to explain a procedure for determining a pitch range according to the present invention. FIG. 3 shows a peak FFT index 31, a frequency range 32 according to the peak FFT index, a frequency range 33 calculated by dividing the h-th harmonic frequency range of the frequency range 32 by "h", and a final pitch range 34 which is an intersection between a current frequency range 33 and a previous final pitch range 34. The values shown in FIG. 3 are related with the peaks shown in FIG. 4C. Here, a final pitch range of 129.1992~134.5825 (in the hatched section in FIG. 3) when the harmonic frequency detection coefficient "h" is 2 is determined by an intersection between a final pitch range of 129.1992~139.9658 obtained when the harmonic frequency detection coefficient "h" is 1 and a frequency range of 129.1992~134.5825 obtained using the second harmonic frequency range when the harmonic frequency detection coefficient "h" is 2. The final pitch ranges with respect to third and next harmonic frequencies are determined in the same manner as the final pitch range with respect to the second harmonic frequency is determined. However, when the harmonic frequency detection coefficient "h" is 13, an intersection does not exist between a final pitch range of 131.3525~131.5918 obtained when the harmonic frequency detection coefficient "h" is 12 and a frequency range of 131.6838-132.5120 obtained using the 13-th harmonic frequency range. Accordingly, a final pitch range is not calculated when the harmonic frequency detection coefficient "h" is 13 or greater. Therefore, a final pitch range of 131.3525~131.5918 obtained when the harmonic frequency detection coefficient "h" is 12 is output as the result of detecting a pitch.

The above description just concerns embodiments of the present invention. The present invention is not restricted to the above embodiments, and various modifications can be made thereto within the scope defined by the attached claims. For example, the shape and structure of each component specified in the embodiments can be changed. Although the pitch candidate property determination coefficient is set to a prime number in the above embodiments, it will be understood by those skilled in the art that the pitch candidate property determination coefficient can be set to a natural number.

INDUSTRIAL APPLICABILITY

According to a pitch detection method and apparatus of the present invention, it is determined whether a maximum peak frequency obtained through frequency analysis is a pitch or an n-order harmonic frequency of the pitch, and then a pitch is detected based on the result of determination, so that a pitch detection error occurring when the maximum peak frequency is unconditionally detected as a pitch can be minimized.

In addition, in the present invention, the frequency range of a pitch is determined based on the range of a harmonic frequency that maintains a predetermined interval with a pitch candidate among detected harmonic frequencies, so that an error range for a pitch is reduced. Consequently, the reliability of pitch detection can be increased.

What is claimed is:

1. A method of detecting a pitch using frequency analysis, comprising:

a first step of analyzing an externally input digital signal into frequency component values at predetermined time intervals and detecting positions of peaks of the digital signal based on the frequency component values;

a second step of selecting a maximum peak position from the detected peak positions, determining whether a frequency at the maximum peak position is a pitch or an n-order harmonic frequency of the pitch, and detecting the pitch based on the result of the determination; and a third step of detecting a position of a harmonic frequency of the pitch determined in the second step and determining the range of the pitch based on the range of the harmonic frequency, wherein the third step comprises:

calculating a frequency range $F_1$ of the pitch determined in the second step;

calculating a frequency range $F_2$ by dividing the range of a harmonic frequency positioned at an h-th place from the pitch among harmonic frequencies, which can be detected with respect to the pitch, by "h"; and determining an intersection between the frequency range $F_1$ and frequency range $F_2$ as the range of the pitch.

2. The method of claim 1, wherein the second step comprises the steps of:

(2-1) determining the frequency at the maximum peak position among the detected peak positions as a pitch candidate;

(2-2) dividing a pitch candidate distance "d" between a frequency analysis start point and the position of the pitch candidate by "n" so as to calculate a peak detection interval d/n and determining whether peaks exist in the frequency spectrum between the frequency analysis start point and the pitch candidate position at peak detection intervals d/n;

(2-3) if it is determined that peaks exist at peak detection intervals d/n, determining the pitch candidate as an n-order harmonic frequency of a peak P_Peak at a position P obtained by dividing the pitch candidate distance "d" by "n";

(2-4) setting the peak P_Peak at the position P as a new pitch candidate and repeating steps (2-2) and (2-3); and (2-5) if it is determined that peaks do not exist at peak detection intervals d/n, determining the pitch candidate as a pitch.

3. The method of claim 1, wherein "n" is a pitch candidate property determination coefficient for determining whether the pitch candidate is the n-order harmonic frequency, and prime numbers within a predetermined range are sequentially applied to "n".

4. The method of claim 1, wherein "n" is a pitch candidate property determination coefficient for determining whether the pitch candidate is the n-order harmonic frequency, and natural numbers within a predetermined range are sequentially applied to "n".

5. The method of claim 1, wherein "h" is a harmonic frequency detection coefficient for selecting a harmonic frequency for determining the pitch range, and a natural number equal to or greater than 2 is used as "h".

6. A method of detecting a pitch using frequency analysis, comprising:

a first step of analyzing an externally input digital signal into frequency component values at predetermined time intervals and determining a pitch based on the frequency component values; and a second step of detecting a position of a harmonic frequency of the determined pitch and determining a range of the pitch based on the range of the harmonic frequency, wherein the second step comprises:

calculating a frequency range $F_1$ of the pitch determined in the first step;

calculating a frequency range $F_2$ by dividing the range of a harmonic frequency positioned at an h-th place from the pitch among harmonic frequencies, which can be detected with respect to the pitch, by "h"; and determining an intersection between the frequency range $F_1$ and the frequency range $F_2$ as the range of the pitch.

7. The method of claim 6, wherein "h" is a harmonic frequency detection coefficient for selecting a harmonic frequency for determining the range of the pitch, and a natural number equal to or greater than 2 is used as "h".

8. An apparatus for detecting a pitch using frequency analysis, comprising:

a frequency analyzer, which analyzes an externally input digital signal into frequency component values at predetermined time intervals and detects positions of peaks of the digital signal based on the frequency component values;

a pitch determiner, which selects a maximum peak position from the peak positions detected by the frequency analyzer as a pitch candidate, determines whether the pitch candidate is a pitch or an n-order harmonic frequency of the pitch, and when the frequency of the maximum peak position is determined as the n-order harmonic frequency, determines a frequency at a position, which is obtained by dividing a distance between a frequency analysis start point and the maximum peak position by "n", as a pitch;

a result output unit, which outputs the pitch determined by the pitch determiner; and a pitch range determiner, which detects a position of a harmonic frequency of the pitch determined by the pitch determiner and determines the range of the pitch based on the range of the harmonic frequency, wherein the pitch range determiner calculates a frequency range $F_1$ of the pitch determined by the pitch determiner; calculates a frequency range $F_2$ by dividing the range of a harmonic frequency positioned at an h-th place from the pitch among harmonic frequencies, which can be detected with respect to the pitch, by "h"; and determines an intersection between the frequency range $F_1$ and the frequency range $F_2$ as the range of the pitch.

9. The apparatus of claim 8, wherein the pitch determiner:

performs a procedure step 1 of dividing a distance "d" between a frequency analysis start point and the pitch candidate by "n" so as to calculate a peak detection interval d/n, determining whether peaks exist in the frequency spectrum between the frequency analysis start point and the pitch candidate at peak detection intervals d/n, and if it is determined that peaks exist at peak detection intervals d/n, determining a peak P_Peak at a position P obtained by dividing the distance "d" by "n" as a new pitch candidate;

repeats the procedure step 1 while peak exist from the frequency analysis start point to the pitch candidate at peak detection intervals d/n; and if it is determined that peaks do not exist at peak detection intervals d/n, determines the pitch candidate as a pitch.

10. The apparatus of claim 9, wherein "n" is a pitch candidate property determination coefficient for determining whether the pitch candidate is the n-order harmonic frequency, and prime numbers within a predetermined range are sequentially applied to "n".

11. The apparatus of claim 9, wherein "n" is a pitch candidate property determination coefficient for determining whether the pitch candidate is the n-order harmonic frequency, and natural numbers within a predetermined range are sequentially applied to "n".

12. The apparatus of claim 8, wherein "h" is a harmonic frequency detection coefficient for selecting a harmonic frequency for determining the pitch range, and a natural number equal to or greater than 2 is used as "h".

13. An apparatus for detecting a pitch using frequency analysis, comprising:

a frequency analyzer, which analyzes an externally input digital signal into frequency component values at predetermined time intervals and detects positions of peaks of the digital signal based on the frequency component values;

a pitch determiner, which selects a maximum peak position from the peak positions detected by the frequency analyzer, determines whether a frequency at the maximum peak position is a pitch or an n-order harmonic frequency of the pitch, and detects the pitch based on the result of the determination;

a pitch range determiner, which detects a position of a harmonic frequency of the pitch determined by the pitch determiner and determines the range of the pitch based on the range of the harmonic frequency; and a result output unit, which outputs a pitch determined by the pitch determiner, wherein the pitch range determiner calculates a frequency range $F_1$ of the pitch determined by the pitch determiner; calculates a frequency range $F_2$ by dividing the range of a harmonic frequency positioned at an h-th place from the pitch among harmonic frequencies, which can be detected with respect to the pitch, by "h"; and determines an intersection between the frequency range $F_1$ and the frequency range $F_2$ as the range of the pitch.

14. The apparatus of claim 13, wherein "h" is a harmonic frequency detection coefficient for selecting a harmonic frequency for determining the pitch range, and a natural number equal to or greater than 2 is used as "h".

* * * * *